US010444705B2

(12) United States Patent
Villar

(10) Patent No.: US 10,444,705 B2
(45) Date of Patent: Oct. 15, 2019

(54) MECHANICAL TIMEPIECE MOVEMENT WITH POWER RESERVE DETECTION

(71) Applicant: ETA SA Manufacture Horlogere Suisse, Grenchen (CH)

(72) Inventor: Ivan Villar, Brugg (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 87 days.

(21) Appl. No.: 15/791,637

(22) Filed: Oct. 24, 2017

(65) Prior Publication Data

US 2018/0164743 A1 Jun. 14, 2018

(30) Foreign Application Priority Data

Dec. 12, 2016 (EP) ..... 16203366

(51) Int. Cl.
*G04B 1/10* (2006.01)
*G04B 9/00* (2006.01)

(52) U.S. Cl.
CPC ..... *G04B 1/10* (2013.01); *G04B 9/005* (2013.01)

(58) Field of Classification Search
CPC . G04B 1/16; G04B 1/20; G04B 1/205; G04B 1/22; G04B 9/00; G04B 9/005; G04B 9/02
See application file for complete search history.

(56) References Cited

U.S. PATENT DOCUMENTS 3,264,819 A * 8/1966 Konrad ..... G04B 1/20 368/209
2001/0024405 A1* 9/2001 Jeanneret ..... G04B 9/00 368/203
2008/0239883 A1* 10/2008 Nagasaka ..... G04B 1/22 368/127
2016/0018787 A1 1/2016 Villar
2016/0274540 A1* 9/2016 Streubel ..... G04B 1/10
2017/0269550 A1* 9/2017 Calame ..... G04B 13/023
2018/0095422 A1* 4/2018 Saglini ..... G04B 1/16
2018/0095424 A1* 4/2018 Saglini ..... G04B 1/12

FOREIGN PATENT DOCUMENTS

EP 1 139 182 A1 10/2001
EP 2 977 828 A1 1/2016

OTHER PUBLICATIONS

European Search Report dated Jun. 23, 2017 in European Application 16203366.6, filed on Dec. 12, 2016 (with English Abstract of Categories of cited documents).

* cited by examiner

*Primary Examiner* — Daniel P Wicklund
(74) *Attorney, Agent, or Firm* — Oblon, McClelland, Maier & Neustadt, L.L.P.

(57) ABSTRACT

The mechanical timepiece movement with power reserve indication includes a barrel system with a winding output connected to a chassis wheel of a differential gear, and with an unwinding output connected to a crown of the differential gear. The differential gear is connected to a power reserve indicator to display the power reserve. The timepiece movement includes at least one locking member disposed on the crown and at least one locking element disposed on the chassis wheel during the rotation of the crown relative to the chassis wheel. The locking member is intended to come into contact with the locking element when the power reserve is at zero, in order to stop the timepiece movement.

12 Claims, 4 Drawing Sheets

MECHANICAL TIMEPIECE MOVEMENT WITH POWER RESERVE DETECTION

This application claims priority from European Patent Application No. 16203366.6 filed on Dec. 12, 2016; the entire disclosure of which is incorporated herein by reference.

FIELD OF THE INVENTION

The present invention concerns a mechanical timepiece movement provided with power reserve detection means. The timepiece movement includes at least one barrel system connected to a winding wheel of a differential gear and an unwinding wheel of the differential gear.

BACKGROUND OF THE INVENTION

A mechanical timepiece movement generally includes a barrel system driving at least one wheel at the winding output and one wheel at the unwinding output respectively connected to a winding wheel and to an unwinding wheel of a differential gear. A set of wheels connected to an intermediate wheel of the differential gear controls a power reserve display, but no element of the movement is provided for an operation to stop the movement when the power reserve is at zero.

EP Patent 0 568 499 B1 describes a power reserve indicator device for a mechanical watch. The indicator device includes at least one star-wheel with an indicator member, which is driven in rotation during the winding or unwinding of the barrel. The indicator member makes it possible to display the power reserve of the watch. However, nothing is provided to ensure that the movement is stopped when the power reserve approaches zero.

CH Patent 698 752 B1 describes a timepiece which includes a power reserve indicator mechanism. It includes two barrels facing each other and connected by a common arbor, which controls the power reserve display mechanism. However, nothing is provided to ensure that the movement is stopped when the power reserve approaches zero.

EP Patent 1 970 778 B1 may also be cited, which describes a timepiece with a movement and a power reserve indicator device. This timepiece includes a barrel system mounted between a watch plate and a bar. The power reserve indicator device includes a differential gear connected by a first input to the barrel arbor and by a second input to the barrel. The differential gear is arranged coaxially to the barrel arbor. The barrel output is connected to a power reserve indicator member. Nothing is provided to ensure that the movement is stopped when the power reserve approaches zero.

SUMMARY OF THE INVENTION

It is therefore a main object of the invention to overcome the drawbacks of the prior art by proposing a mechanical timepiece movement provided with power reserve detection means and capable of stopping operation of the movement when the power reserve is close to zero.

To this end, the present invention concerns a mechanical timepiece movement provided with power reserve detection, comprising at least one barrel system with a winding output connected to a winding wheel, such as a chassis wheel of a differential gear, and with an unwinding output connected to an unwinding wheel, such as a crown of the differential gear, wherein the differential gear is connected to a power reserve indicator to display the power reserve, and wherein it includes at least one locking member disposed on the crown and at least one locking element disposed on the chassis wheel, during the rotation of the crown relative to the chassis wheel, the locking member being intended to come into contact with the locking element, when the power reserve is at zero in order to stop the timepiece movement.

Particular embodiments of the mechanical timepiece movement are defined in the dependent claims 2 to 12.

One advantage of the mechanical timepiece movement lies in the fact that it includes a differential gear connected to the barrel system by means of a driving wheel set and a set of wheels of one or two reduction gear stages. The differential gear includes a crown on which are coaxially mounted a solar pinion of a power reserve indicator, and a chassis wheel mounted on an axial arbor of the solar pinion. A locking element is mounted on the chassis wheel to come into contact with a locking member of the crown when the power reserve detection position to be indicated is zero.

Advantageously, the locking element is a planet-wheel driven in rotation by an inner surface of the edge of the crown. A locking member in the form of a notch or a truncated toothing portion is provided for locking the planet-wheel in a minimum power reserve position, which also stops the timepiece movement. Another locking member may also be provided to lock the planet-wheel in a maximum power reserve position.

BRIEF DESCRIPTION OF THE DRAWINGS

The objects, advantages and features of a mechanical timepiece movement provided with power reserve detection means will appear more clearly in the following description, in a non-limiting manner, with reference to the drawings, in which.

DETAILED DESCRIPTION OF THE INVENTION

In the following description, all those components of a mechanical timepiece movement provided with power reserve detection means that are well known to those skilled in the art in this technical field will be described only in a simplified manner.

Figure 1:
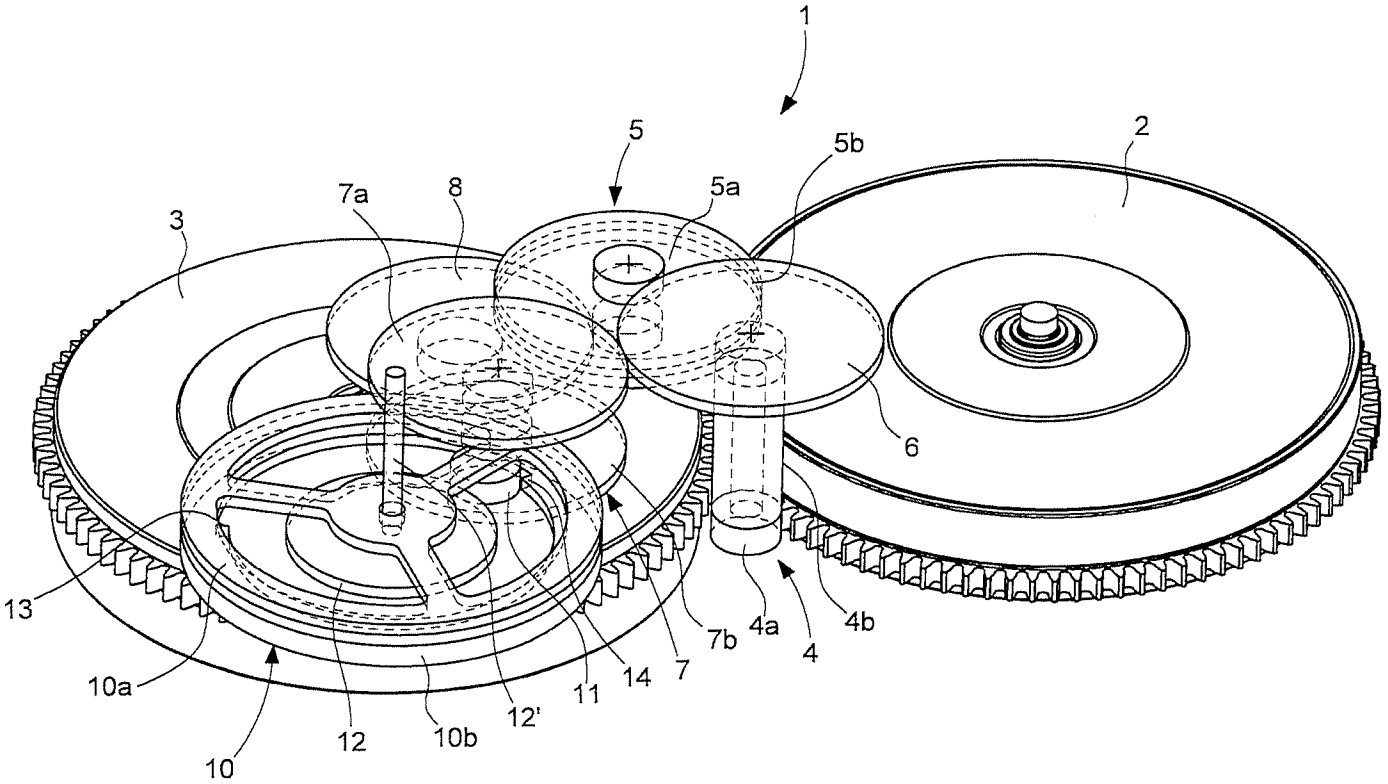
FIG. 1 represents a three-dimensional top view of an embodiment of a mechanical timepiece movement provided with power reserve detection means according to the invention.

FIG. 1 represents a three-dimensional top view of certain components of the mechanical timepiece movement 1. Mechanical timepiece movement 1 includes at least one barrel system, which may be a well known system with a single barrel or with two barrels 2, 3 as represented, and having a winding output and an unwinding output for driving, in particular, a time base gear train (not represented).

Mechanical timepiece movement 1 includes a differential gear 10 mounted to rotate about a rotational axis and respectively connected to the winding output and to the unwinding output of the barrel system. Differential gear 10 is preferably connected via a reduction stage or rotational speed reducing chain to the winding output from first barrel 2 and to the unwinding output from second barrel 3. A driving wheel set 4 may be provided between barrel system 2, 3 and differential gear 10. This driving wheel set 4 may comprise a central arbor 4*a* and a ring 4*b* disposed coaxially around the arbor. Ring 4*b* is held on an intermediate portion of central arbor 4*a* between two rims of central arbor 4*a* while allowing rotation of the ring about the central arbor. The diameter of the rims or of the two ends of arbor 4*a* may be identical to the external diameter of ring 4*b*.

The winding output wheel of first barrel 2 is in contact with a first rim or first end of central arbor 4*a* to drive it in rotation. The winding output wheel of first barrel 2 may include a toothing for meshing with a toothing of the first rim or first end of central arbor 4*a*. The unwinding output wheel of second barrel 3 is in contact with ring 4*b* to drive it in rotation. The unwinding output wheel of second barrel 3 may include a toothing for meshing with a toothing of ring 4*b*.

As will be explained in more detail in FIGS. 2 to 5 below, driving wheel set 4 drives in rotation a set of wheels 5, 6, 7, 8 of a reduction stage between barrel system 2, 3 and differential gear 10. From the winding output of first barrel 2, driving wheel set arbor 4*a* drives, via its second rim, the set of wheels 5*a*, 6, 7*a* of a first reduction stage, whose third wheel 7*a* is in contact with a first winding wheel 10*a* of differential gear 10, which is a chassis wheel in the form of a flywheel. From the unwinding output of second barrel 3, ring 4*b* of driving wheel set 4 drives the set of wheels 5*b*, 8 and 7*b* of a second reduction stage, whose third wheel 7*b* is in contact with a crown 10*b* of differential gear 10. Crown 10*b* is preferably disposed coaxially to chassis wheel 10*a*.

Differential gear 10 thus includes a crown 10*b*, a chassis wheel 10*a* coaxial to the crown and a solar pinion 12 with an axial arbor 12' as the power reserve indicator. Axial arbor 12' passes through a central opening in chassis wheel 10*a* and may be connected to a power reserve indicator hand (not represented). Solar pinion 12 is placed on a base of crown 10*b* between chassis wheel 10*a* and crown 10*b* and is coaxial to chassis wheel 10*a* and to crown 10*b*. Preferably, the external diameter of crown 10*b* is similar to the external diameter of chassis wheel 10*a*, whereas the diameter of solar pinion 12 is smaller in order to be placed inside the peripheral edge of crown 10*b*.

Differential gear 10 also includes at least one member 13, 14 for stopping the movement connected to crown 10*b* and preferably to the peripheral edge of the crown to cooperate with at least one locking element 11 connected to chassis wheel 10*a* to stop the timepiece movement in a zero power reserve position of the barrel system, possibly also in a maximum winding position of the barrel system.

Chassis wheel 10*a* of differential gear 10 includes, as the locking element, at least one planet-wheel 11 mounted to rotate on an axial arm of chassis wheel 10*a*. This planet-wheel 11 is in contact with a circular inner surface of the peripheral edge of crown 10*b* and driven in rotation during the rotation of crown 10*b* relative to chassis wheel 10*a*. Preferably, the inner surface of crown 10*b* includes over at least one portion of its periphery a toothing for meshing with a toothing of planet-wheel 11. Solar pinion 12 is driven by planet-wheel 11 in contact with its peripheral edge. Solar pinion 12 may also comprise a toothing for meshing with planet-wheel 11. The peripheral edge of crown 10*b*, planet-wheel 11 and solar pinion 12 are disposed in the same plane on the base of crown 10*b*.

When planet-wheel 11 enters into contact with at least a first locking element, which may be a first notch 13 or a first truncated toothing portion, crown 10*b* is locked in rotation relative to chassis wheel 10*a*. This also has the effect of stopping the timepiece movement when the power reserve is at zero. During winding of the barrel system, planet-wheel 11 enters into contact with a second locking member, which may be a second notch 14 or a second truncated toothing portion. Crown 10*b* is then locked in rotation relative to chassis wheel 10*a*, which also has the effect of stopping the timepiece movement upon completion of winding of the barrel system. The angle of rotation of the crown relative to the chassis wheel between the two locking positions may be set between 90° and 180° for example, but other angles may be set.

Figure 2:
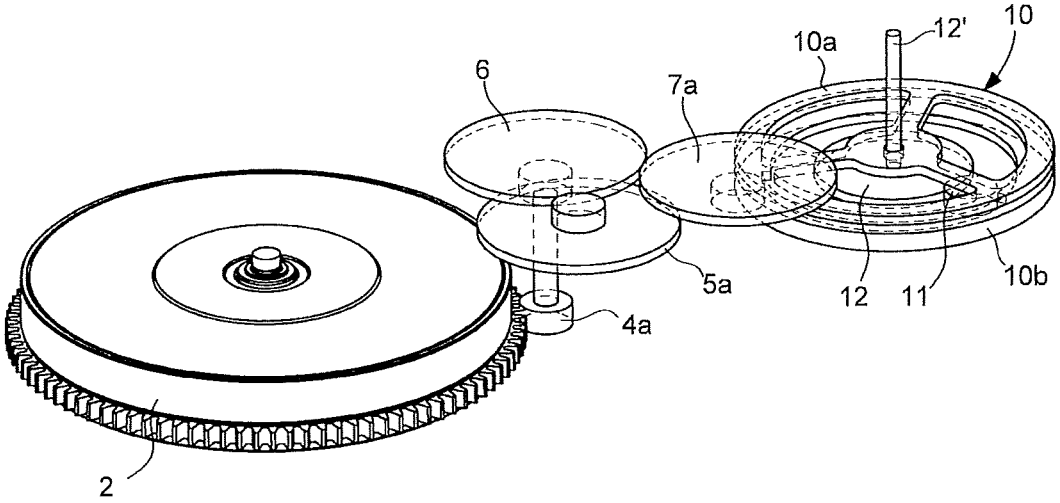
FIG. 2 represents a three-dimensional top view of a barrel and a train for the function or winding or charging the barrel according to the invention.
Figure 3:
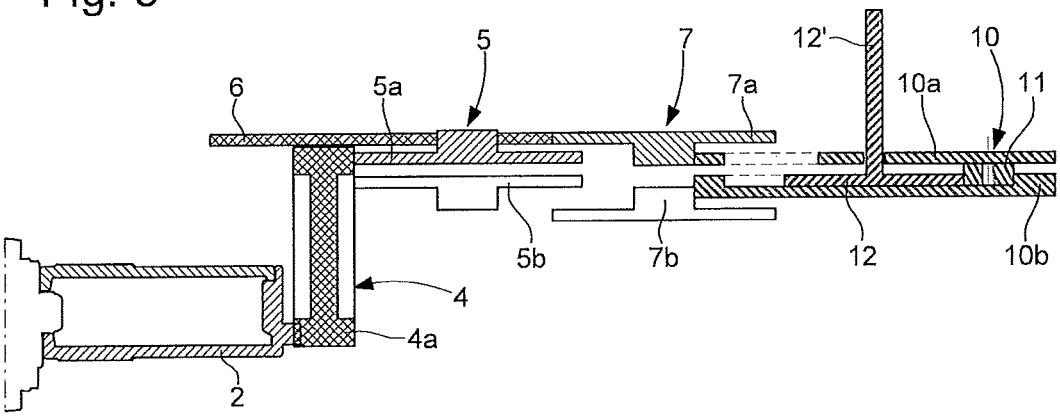
FIG. 3 represents a partial cross-sectional side view of the barrel system and of the power reserve detection means disposed on a line to better represent the set of wheels for the barrel winding or charging function according to the invention.

FIGS. 2 and 3 represent a three-dimensional top view and a partial cross-sectional vertical view of first barrel 2 of the barrel system, of the set of wheels and of differential gear 10 for the barrel system winding or charging function.

These FIGS. 2 and 3 clearly show central arbor 4*a* of driving wheel set 4, which is driven in rotation by the winding output wheel of first winding barrel 2 in contact with the first rim of central arbor 4*a*. The second rim of central arbor 4*a* drives a first wheel 5*a* of the first reduction stage. The second rim may comprise a toothing for meshing with an external toothing of first wheel 5*a*. A central pinion of first wheel 5*a* drives a second reverser wheel 6. The central pinion of the first wheel is of smaller diameter than the external toothing of first wheel 5*a* to reduce the rotational speed of second wheel 6 compared to the rotational speed of first wheel 5*a*. The central pinion may include a toothing for meshing with an external toothing of second wheel 6. Second wheel 6 drives third wheel 7*a* acting solely as a reverser wheel. Third wheel 7*a* may include an external toothing for meshing with an external toothing of second wheel 6. A central pinion of third wheel 7*a* is in contact with chassis wheel 10*a* of differential gear 10. This central pinion is of smaller diameter than the external toothing of third wheel 7*a* and may also include a toothing for meshing with an external toothing of chassis wheel 10*a*.

Figure 4:
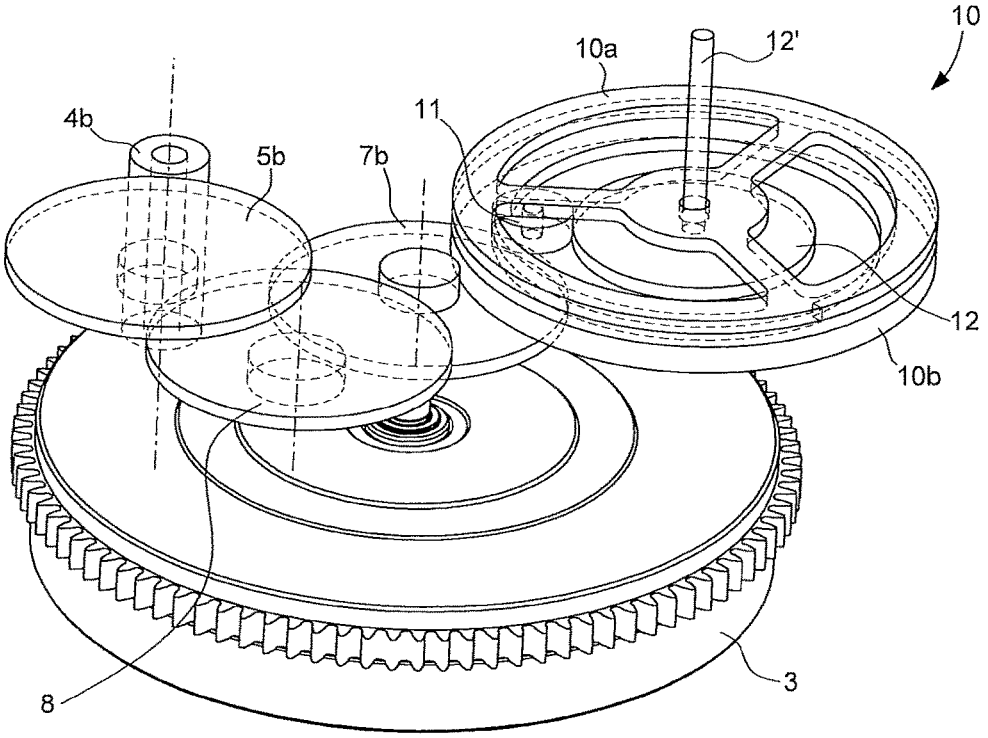
FIG. 4 represents a three-dimensional top view of a barrel and a train for the function of unwinding or discharging the barrel according to the invention.
Figure 5:
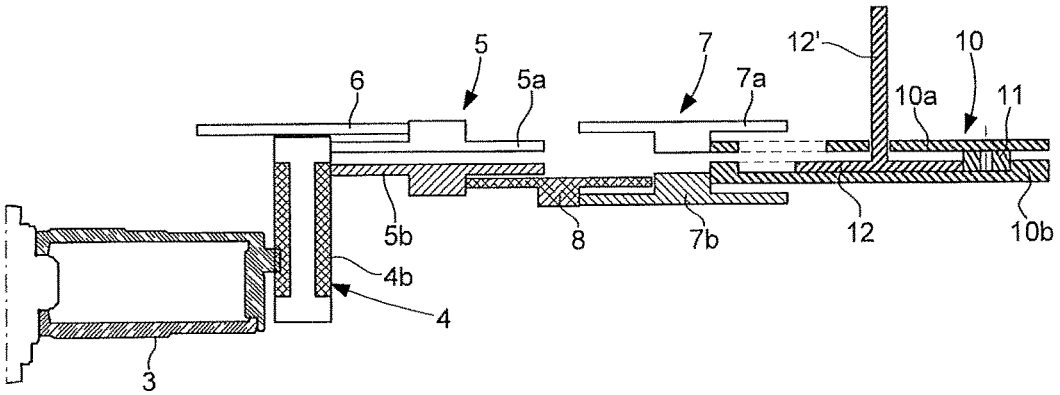
FIG. 5 represents a partial cross-sectional side view of the barrel system and of the power reserve detection means disposed on a line to better represent the set of wheels for the barrel unwinding or discharging function according to the invention.

FIGS. 4 and 5 represent a three-dimensional top view and a partial cross-sectional vertical view of second barrel 3 of the barrel system, of the set of wheels and of differential gear 10 for the barrel system unwinding or discharging function.

These FIGS. 4 and 5 clearly show ring 4*b* of driving wheel set 4, which is driven in rotation by the unwinding output wheel of second unwinding barrel 3 in contact with ring 4*b*. Ring 4*b* drives a first wheel 5*b* of the second reduction stage. Ring 4*b* may comprise a toothing for meshing with an external toothing of first wheel 5*b*. A central pinion of first wheel 5*b* drives a second wheel 8. The central pinion of the first wheel is of smaller diameter than the external toothing of first wheel 5*b* to reduce the rotational speed of second wheel 8 compared to the rotational speed of first wheel 5*b*. The central pinion may include a toothing for meshing with an external toothing of second wheel 8. A central pinion of second wheel 8 drives a third wheel 7*b*. The central pinion of second wheel 8 is of smaller diameter than the external toothing of second wheel 8. Third wheel 7*b* may include an external toothing for meshing with a toothing of the central pinion of second wheel 8. A central pinion of third wheel 7*b* is in contact with the external edge of crown 10*b* of differential gear 10. This central pinion is of smaller diameter than the external toothing of third wheel 7*b* and may also include a toothing for meshing with an external toothing of the external edge of crown 10*b*.

Figure 6A:
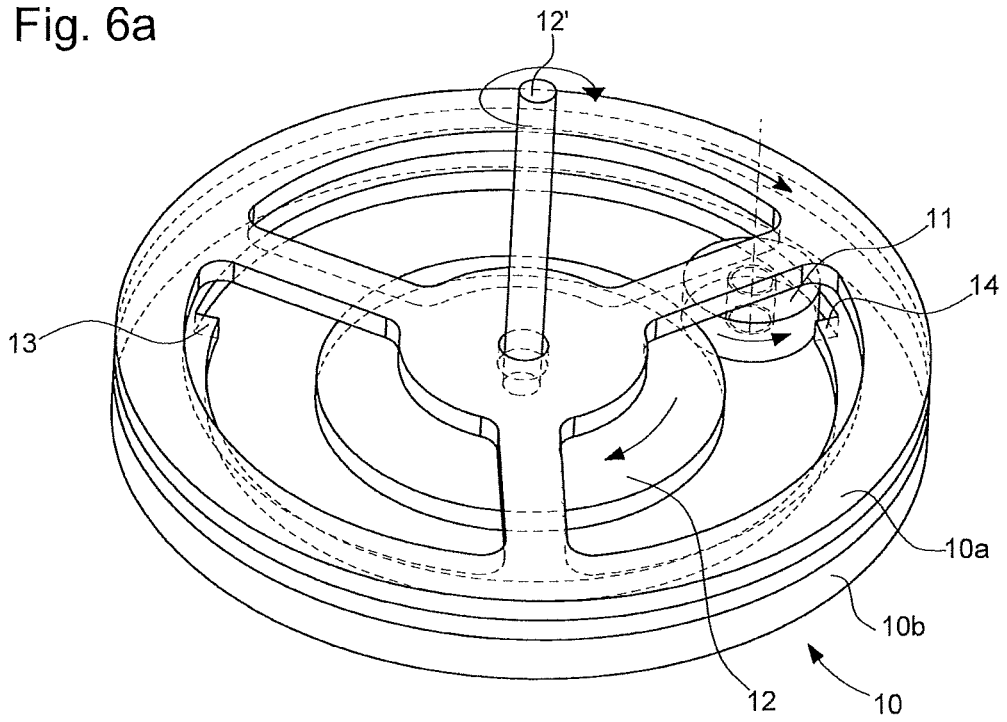
FIGS. 6*a* and 6*b* represent a three-dimensional view of the differential planet gear with these elements for locking the mechanical timepiece movement in the maximum power reserve position and in the minimum power reserve position according to the invention.
Figure 6B:
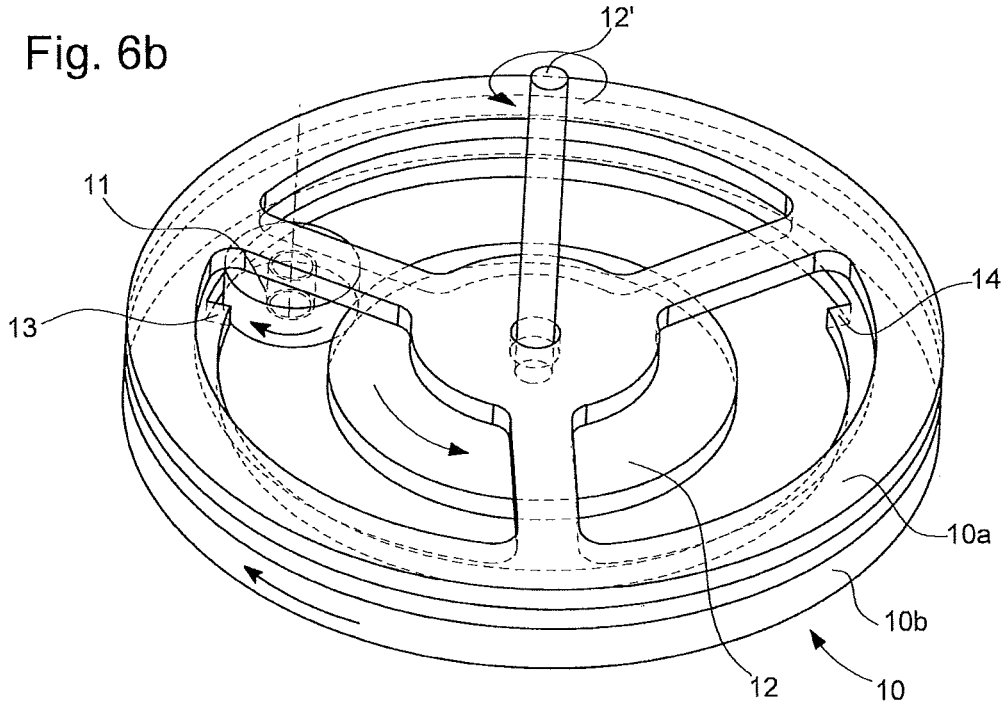

FIGS. 6*a* and 6*b* represent a three-dimensional view of differential planet gear 10. Differential planet gear 10 is represented in FIG. 6*a* in the maximum power reserve position, whereas in FIG. 6*b*, it is represented in the zero power reserve position. The moving parts are represented with an arrow indicating the direction of rotation of each part before locking.

Differential gear 10 is represented with a crown 10*b*, which includes a peripheral edge and a base or bottom, a solar pinion 12 coaxially mounted on the base of the crown and a chassis wheel 10*a* coaxially mounted on arbor 12' of solar pinion 12. Planet-wheel 11 is mounted to rotate about an arbor fixed to one of the three axial arms of chassis wheel 10*a*. Planet-wheel 11 is driven in rotation by the inner edge surface of crown 10*b*. Driving planet-wheel 11 in rotation also causes rotation of solar pinion 12 in contact with planet-wheel 11. Thus, solar pinion 12 is a piece of a power reserve indicator, which may also include a hand fixed to the end of arbor 12' of solar pinion 12. Sufficient space is provided between crown 10*b* and chassis wheel 10*a* while allowing planet-wheel 11 to be driven by the inner edge surface of crown 10*b*.

Planet-wheel 11 is locked by a first locking member 13 of the edge of crown 10*b* in FIG. 6*b* showing the zero power reserve detection position. Planet-wheel 11 is locked by a second locking member 14 of the edge of crown 10*b* in FIG. 6*a* showing the maximum power reserve detection position.

Evidently, each locking member 13, 14 may have a different shape to that shown in FIGS. 6*a* and 6*b*, but allowing planet-wheel 11 to be locked in the two maximum and minimum power reserve detection positions. The locking of planet-wheel 11 mounted on the chassis wheel makes it possible to stop the timepiece movement as expected.

From the description that has just been given, several variant embodiments of the mechanical timepiece movement with power reserve detection means may be devised by those skilled in the art without departing from the scope of the invention defined by the claims. The locking element of the chassis wheel may be a lug instead of the planet-wheel for locking against a locking member of the crown.

What is claimed is:

1. A mechanical timepiece movement with power reserve indication, comprising at least one barrel system with a winding output connected to a winding wheel comprising a chassis wheel of a differential gear, and with an unwinding output connected to an unwinding wheel comprising a crown of the differential gear, wherein the differential gear is connected to a power reserve indicator to display the power reserve, and wherein the differential gear includes at least one locking member disposed on the crown and at least one locking element disposed on the chassis wheel, during the rotation of the crown relative to the chassis wheel, the locking member being intended to come into contact with the locking element, when the power reserve is at zero in order to stop the timepiece movement.

2. The mechanical timepiece movement according to claim 1, wherein the chassis wheel is mounted coaxially to the crown.

3. The mechanical timepiece movement according to claim 1, wherein the crown includes a peripheral edge and a base, the locking member being disposed on an inner side of the peripheral edge.

4. The mechanical timepiece movement according to claim 3, wherein the chassis wheel includes a planet-wheel as the locking element, which is mounted for free rotation on the chassis wheel, the planet-wheel being in contact with a circular inner surface of the peripheral edge of the crown to be driven in rotation during the rotation of the crown or of the chassis wheel.

5. The mechanical timepiece movement according to claim 4, wherein the planet-wheel is arranged for free rotation on one of axial arms of the chassis wheel.

6. The mechanical timepiece movement according to claim 4, wherein the power reserve indicator is a solar pinion with an axial arbor, the solar pinion being disposed between the crown and the chassis wheel and the axial arbor passing through a central opening in the chassis wheel.

7. The mechanical timepiece movement according to claim 6, wherein the solar pinion is in contact with the planet-wheel in order to be driven in rotation during the rotation of the planet-wheel.

8. The mechanical timepiece movement according to claim 4, wherein:

the at least one locking member comprises a first locking member and a second locking member, and the peripheral edge of the crown includes on the inner surface of the crown, the first locking member and the second locking member angularly offset from the first locking member, wherein the planet-wheel is driven in rotation during the rotation of the crown or of the chassis wheel as far as the first locking member in the unwinding phase of the barrel system to stop the timepiece movement upon contact with the first locking member when the power reserve is at zero, and wherein the planet-wheel is driven in rotation during the rotation of the crown or of the chassis wheel as far as the second locking member in the winding phase of the barrel system to stop the timepiece movement upon contact with the second locking member.

9. The mechanical timepiece movement according to claim 3, wherein each locking member is a notch or a truncated toothing portion for locking in cooperation with the locking element of the chassis wheel.

10. The mechanical timepiece movement according to claim 1, wherein a first reduction stage is disposed between the winding output of the barrel system and the chassis wheel.

11. The mechanical timepiece movement according to claim 10, wherein a second reduction stage is disposed between the unwinding output of the barrel system and the crown.

12. The mechanical timepiece movement according to claim 11, wherein the movement includes a driving wheel set, which is composed of a central arbor and of a ring mounted for free rotation between two rims of the central arbor, wherein the central arbor is connected to the winding output of the barrel system and to the first reduction stage, whereas the ring is connected to the unwinding output of the barrel system and to the second reduction stage.

* * * * *